US005603264A

United States Patent [19]

DeMoore et al.

[11] Patent Number: 5,603,264

[45] Date of Patent: Feb. 18, 1997

[54] METHOD AND APPARATUS FOR HANDLING PRINTED SHEET MATERIAL

[75] Inventors: Howard W. DeMoore, 10954 Shady Trail, Dallas, Tex. 75220; John A. Branson, Coppell, Tex.

[73] Assignee: Howard W. DeMoore, Dallas, Tex.

[21] Appl. No.: 528,701

[22] Filed: Sep. 15, 1995

Related U.S. Application Data

[62] Division of Ser. No. 259,634, Jun. 14, 1994.

[51] Int. Cl.[6] ..... B41F 5/00

[52] U.S. Cl. ..... 101/483; 101/419

[58] Field of Search ..... 101/416.1, 420, 101/419, 422, 229, 230, 231, 232, 483, 492; 492/30, 32, 56

[56] References Cited

U.S. PATENT DOCUMENTS 3,791,644 2/1974 DeMoore ..... 101/422

4,402,267 9/1983 DeMoore ..... 101/422

5,042,384 8/1991 DeMoore et al. ..... 101/416.1

*Primary Examiner*—Ren Yan

*Attorney, Agent, or Firm*—Sidley & Austin

[57] ABSTRACT

A transfer cylinder for supporting freshly printed sheet material between printing units or at the delivery unit of a printing press is provided with an ink repellent, flexible jacket covering for supporting and transporting the sheet material without transfer of wet ink from one sheet to a successive sheet and without smearing the ink or causing indentations on the surface of the sheet material. The circumferential support surface of the transfer cylinder is covered with a conductive, fluoropolymer layer secured to the surface of the transfer cylinder beneath the protective, wash-free disposable flexible jacket covering. The low friction properties of the conductive base covering permit free movement of the ink repellent, flexible jacket covering relative to the transfer cylinder surface. Electrostatic charges delivered to the flexible jacket covering by the printed sheet material are drawn away from the flexible jacket covering and are discharged into the transfer cylinder by the conductive base covering.

10 Claims, 6 Drawing Sheets

METHOD AND APPARATUS FOR HANDLING PRINTED SHEET MATERIAL

CROSS REFERENCE TO RELATED APPLICATION

This is a division of application Ser. No. 08/259,634, filed Jun. 14, 1994, now pending.

FIELD OF THE INVENTION

This invention concerns method and apparatus for providing improved support for freshly printed sheet material in a printing press.

BACKGROUND OF THE INVENTION

In the operation of a multi-unit rotary offset printing press, freshly printed sheets are transported by transfer devices from one printing unit to another, and then they are delivered to a sheet stacker. Sheet transfer devices are known by various names including transfer cylinders, support rollers, delivery wheels, delivery cylinders, skeleton wheels, transfer drums, support wheels, guide wheels and the like. The ink marking problems inherent in transferring freshly printed sheets have been longstanding. In order to minimize the contact area between the transfer cylinder and the printed sheet, conventional support wheels have been modified in the form of relatively thin disks having a toothed or serrated circumference, referred to as skeleton wheels. However, those types of wheels have not overcome the problems of smearing and marking the printed surface of the printed sheet material due to sliding action between the printed sheet material and the projections or serrations. Moreover, the attempts to minimize the surface support area in contact with the sheet material has also resulted in actual indenting or dimpling of the material itself.

DESCRIPTION OF THE PRIOR ART

Various efforts have been made to overcome the disadvantages of thin disk skeleton wheels. One of the more successful approaches has been completely contrary to the concept of minimizing the surface area of contact. That improvement is disclosed and claimed in my U.S. Pat. No. 3,791,644 wherein I provide for a substantially cylindrical wheel or roller coated with an improved ink repellent surface formed by a layer of polytetrafluoroethylene (PTFE).

During the use of the PTFE coated cylinder in high speed commercial printing equipment, the surface of the coated cylinder must be washed relatively frequently with a solvent to remove any ink accumulation. Moreover, it has also been determined that the PTFE coated cylinders do not provide a cushioning effect which is needed to protect the sheet material as it is transferred around the curvilinear transfer path by the transfer cylinder grippers.

The limitations on the use of the conventional skeleton wheel and PTFE coated transfer cylinder have been overcome with a transfer cylinder having an ink repellent and supportive flexible jacket covering or the like for handling the freshly printed sheet material. It is now well recognized and accepted in the printing industry world-wide that marking and smearing of freshly printed sheets caused by engagement of the wet printed surface with the supporting surface of a conventional press transfer cylinder is substantially eliminated by using the anti-marking flexible covering system as disclosed and claimed in my U.S. Pat. No. 4,402,267 entitled "Method and Apparatus for Handling Printed Sheet Material", the disclosure of which is incorporated herein by reference. That system, which is marketed under license by Printing Research, Inc. of Dallas, Tex. under the registered trademark "SUPER BLUE", includes the use of a low friction coating on the supporting surface of the transfer cylinder, and over which is loosely disposed a movable covering or jacket of flexible material, referred to as a "flexible jacket covering". The flexible jacket covering provides a yieldable, cushioning support for the freshly printed side of the printed sheet such that any relative movement between the printed sheet and the transfer cylinder surface takes place between the surface of the flexible jacket covering and the support surface of the cylinder so that marking and smearing of the freshly printed surface is substantially reduced.

Although the improved "SUPER BLUE" transfer cylinder has achieved world-wide commercial success, with continuous use such as is common in many printing operations, there is over a period of time a slight accumulation of ink on the surface of the flexible jacket covering.

Investigation and testing has identified the build-up of an electrostatic charge on the flexible jacket covering as a factor which tends to impede completely free movement of the flexible jacket covering. The electrostatic charge build-up also appears to cause a faster accumulation of ink deposits so that the flexible jacket covering becomes ink encrusted. The build-up of the static electric charge on the flexible jacket covering is caused by "frictional electricity", which is the transfer of electrons from one material to another when they are pressed or rubbed together.

According to one theory, the transfer of electrostatic charges between two contacting dielectrics, such as a fabric flexible jacket covering and a paper or other substrate sheet, is proportional to the difference between their dielectric constants, with the electrostatic charge moving from the material having the lower dielectric constant to the material having the higher dielectric constant. Since a flexible jacket covering of the woven fabric type typically used in the "SUPER BLUE" flexible jacket covering system has a higher dielectric constant as compared to the dielectric constant of a sheet of paper, for example, the electrostatic charge picked up by the sheets of paper from frictional contact with press parts as the sheets travel through the press, is transferred to the flexible jacket covering as the sheet is transported around the transfer or delivery cylinder.

Those transfer cylinders whose transfer surface is covered by a synthetic or natural organic resin, for example, as disclosed in my U.S. Pat. No. 4,402,267, have a low-friction surface and also have electrical insulating, dielectric properties which make them an accumulator of electrostatic charges carried by the printed sheets. That is, the electrical charge which is transferred from the printed sheets to the flexible jacket covering are also transferred to the underlying low friction, cylinder base covering. As a consequence of such electrostatic charge transfer and accumulation, the flexible jacket covering tends to cling to the underlying cylinder base covering surface and does not move as freely because of the force of electrostatic attraction between the flexible jacket covering and the cylinder base covering.

The resultant build-up of electrostatic charges on the flexible jacket covering appears to make the flexible jacket covering more attractive to the printed image carried on the printed sheet, with the result that the ink accumulation and encrusting action is accelerated, and the flexible jacket covering must be replaced more frequently. Additionally, the build-up of an electrostatic charge on the flexible jacket covering makes it less flexible, with the result that free movement of the flexible jacket covering relative to the cylinder support surface is impaired. Consequently, the ability of the flexible jacket covering to provide movable, cushioning support for the printed side of the freshly printed sheet is substantially reduced by the accumulation of electrostatic charges in the flexible jacket covering and the transfer cylinder covering.

SUMMARY OF THE INVENTION

The present invention provides an improved method and apparatus for handling sheet material which has been freshly printed on at least one side wherein the sheet material is supported by an ink repellent covering or jacket of flexible material which is relatively loosely supported on the support surface of the cylinder. In accordance with one aspect of the present invention, the build-up of electrostatic charges on the loosely mounted flexible jacket covering is prevented by interposing a layer or covering of conductive material, having a low coefficient of friction which is less than the coefficient of friction of the transfer cylinder surface, whereby electrostatic charges delivered to the flexible jacket covering by frictional contact with the freshly printed sheet material is in turn drawn off and discharged through the low frictional coefficient conductive layer or covering into the transfer or delivery cylinder. Consequently, the build-up or accumulation of electrostatic charges on the flexible, ink repellent jacket covering cannot occur, since such charges are conducted immediately through the conductive base covering into the transfer cylinder and into the grounded frame of the printing press.

In accordance with another aspect of the present invention, movement of the ink repellent, flexible jacket covering relative to the transfer cylinder is improved by a base covering of a low frictional coefficient material disposed on the sheet support surface of the transfer cylinder. The low frictional coefficient base covering material has a frictional coefficient which is less than the frictional coefficient of the sheet support surface, and has radially projecting surface portions which reduce the surface area available for frictional engagement. The surface of the base covering material is structurally differentiated and is characterized by radially projecting portions which reduce the amount of surface area available for contact with the flexible jacket covering. The structurally differentiated, radially projecting surface portions are provided by weft and warp strands of woven material in one embodiment, and by nodes or beads in another embodiment. The structurally differentiated base covering embodiment is useful for reducing the frictional drag imposed against the flexible jacket covering. It is not necessary that the structurally differentiated base covering embodiment be rendered conductive, where other means such as a conductive wire or foil or the like is used in the press for discharging electrostatic charges carried by the printed sheets. A base covering having a structurally differentiated surface thus has utility for reducing frictional drag in the non-conductive embodiment, and also has utility for enhancing electrostatic discharge from the flexible jacket covering in the conductive embodiment.

In a preferred embodiment of the present invention, the low coefficient of friction, conductive base covering for the transfer cylinder comprises a woven polyamide fiberglass fabric coated with an organic fluoropolymer which contains a conductive agent such as carbon black, graphite or the like. The flexible jacket covering is supported on the low friction, conductive base covering to accommodate any slight relative movement between the printed sheet material and the transfer cylinder surface without marking the freshly printed surface or damaging the sheet material itself.

In accordance with another embodiment of the present invention, the cylindrical support surface of the transfer cylinder is covered by a layer of conductive fluoropolymer resin which forms a low friction, electrically conductive supporting surface for the flexible jacket covering. Preferably, the surface of the conductive layer is structurally differentiated by nodes or beads.

TECHNICAL ADVANTAGES OF THE INVENTION

The present invention provides a substantially improved yet simple and reliable transfer cylinder and sheet handling apparatus which is adapted to support the freshly printed surface of a printed sheet, without smearing or marking the printed surface and without damaging the printed material. The improved transfer cylinder of the present invention is easily installed on a printing press. The ink repellent, flexible jacket covering is easily removed for disposal and replacement as needed.

The ink repellent, flexible jacket covering and the underlying low coefficient of friction, conductive base covering on the cylinder surface are electrostatically neutralized with respect to each other, so that the flexible jacket covering remains movable with respect to the conductive base support surface of the cylinder. Another beneficial result of the neutralizing action is that the flexible jacket covering becomes more resistant to ink accumulation and encrustation. Yet another advantage of the electrostatically neutralized flexible jacket covering is that it retains its natural flexibility and movability in the absence of electrostatic charge accumulation. Good flexibility and movability of the flexible jacket covering are essential so that any movement between the freshly printed sheet and the conductive base support covering of the cylinder will take place between the movable surface of the flexible jacket covering and the conductive support surface, thus avoiding marking and smearing of the freshly printed material.

Because of the selected polymeric materials used in the construction of the conductive base covering, the transfer cylinder has longer wear life, requires less maintenance, and provides greater operating efficiencies. Since the fluorocarbon polymer surface of the conductive base covering is both oleophobic and hydrophobic, it resists wetting. It is not necessary to wash the conductive base support surface of the cylinder since the neutralized flexible jacket covering is ink repellent and prevents the deposit of ink onto the conductive base support surface, thus eliminating maintenance time and labor, while improving quality and increasing productivity. Consequently, there are no contaminated clean-up rags to handle, and there are no hazardous waste disposal problems. Because transfer cylinder clean-up is rendered unnecessary by the present invention, the exposure of press room personnel to clean-up solvents is substantially reduced. Moreover, the risk of transfer cylinder clean-up injury to press personnel is eliminated since it is no longer necessary to reach into the press to clean the transfer cylinder surface.

Also, the fluorocarbon polymer base covering is resistant to attack by commonly used press room chemicals.

Removal of the static charge from the freshly printed sheets makes sheet handling easier at the delivery unit. By eliminating the electrostatic charge on the freshly printed sheet, the printed sheet is more easily jogged to achieve a uniform stack of sheets. Another significant advantage is that offset or set-off in the delivery stacker is reduced because the electrostatically neutralized printed sheets may be delivered gently and uniformly into the delivery stacker. The electrostatic charges are removed from the freshly printed sheets as they are transferred through the press, so that each printed sheet is electrostatically neutralized as it is delivered to the stacker.

Those skilled in the art will recognize these advantages as well as other superior features of the present invention upon reading the detailed description which follows with reference to the drawings.

DETAILED DESCRIPTION OF THE PREFERRED EMBODIMENT

As used herein, "fluoropolymer" means and refers to fluorocarbon polymers, for example polytetrafluoroethylene, polymers of chlorotrifluoroethylene, fluorinated ethylenepropylene polymers, polyvinylidene fluoride, hexafluoropropylene, and other elastomeric high polymers containing fluorene, also known and referred to as fluoroelastomers.

The improved method and apparatus for handling freshly printed sheet material in accordance with the present invention is used in combination with high speed printing equipment of the type used, for example, in offset printing. Such equipment may include one or more transfer cylinders 10 for handling the sheet material between printing units and upon delivery of the printed material to a delivery stacker. The particular location of the improved transfer cylinder 10 of the present invention at an interstation transfer position (T1, T3) or at a delivery position (T4) in a typical rotary offset printing press 12 is believed to be readily understandable to those skilled in the art. In any case, reference may be made to my earlier U.S. Pat. Nos. 3,791,644 and 4,402,267 which disclose details regarding the location and function of a flexible jacket covering equipped transfer cylinder for a typical multistation printing press. The present invention may, of course, be utilized with printing presses having any number of printing units or stations.

Figure 1:
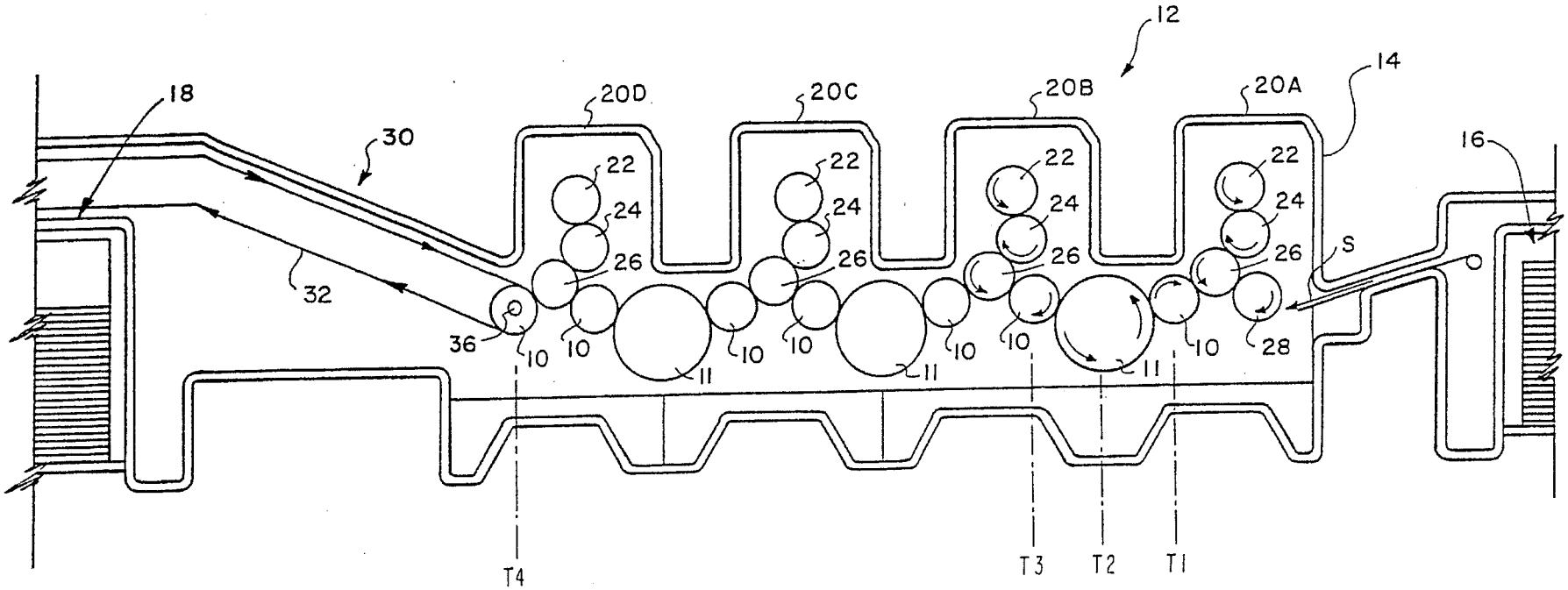
FIG. 1 is a schematic side elevational view in which multiple transfer cylinders of the present invention are installed at interstation positions in a four color rotary offset printing press.

Referring to FIG. 1, the press 12 includes a press frame 14 coupled on its right end to a sheet feeder 16 from which sheets, herein designated S, are individually and sequentially fed into the press, and at its opposite end, the press 12 is coupled to a sheet stacker 18 in which the printed sheets are collected and stacked. Interposed between the sheet feeder 16 and the sheet stacker 18 are four substantially identical sheet printing units 20A, 20B, 20C, and 20D which are capable of printing different color inks onto the sheets as they are transferred through the press.

As illustrated in FIG. 1, each printing unit is of conventional design, and includes a plate cylinder 22, a blanket cylinder 24 and an impression cylinder 26. Freshly printed sheets S from the impression cylinder are transferred to the next printing unit by a transfer cylinder 10. The initial printing unit 20A is equipped with a sheet in-feed roller 28 which feeds individual sheets one at a time from the sheet feeder 16 to the initial impression cylinder 26.

The freshly printed sheets S are transferred to the sheet stacker 18 by a delivery conveyor system, generally designated 30. The delivery conveyor 30 is of conventional design and includes a pair of endless delivery gripper chains 32 carrying laterally disposed gripper bars, each having gripper elements for gripping the leading edge of a freshly printed sheet S as it leaves the impression cylinder 26 at the delivery position T4. As the leading edge of the printed sheet S is gripped by the grippers, the delivery chains 32 pull the gripper bars and sheet S away from the impression cylinder 26 and transport the freshly printed sheet S to the sheet delivery stacker 18.

An intermediate transfer cylinder 11 receives sheets printed on one side from the transfer cylinder 10 of the preceding printing unit. Each intermediate transfer cylinder 11, which is of conventional design, typically has a diameter twice that of the transfer cylinder 10, and is located between two transfer cylinders 10, at interstation transfer positions T1, T2 and T3, respectively. The impression cylinders 26, the intermediate transfer cylinders 11, the transfer cylinders 10, as well as the sheet in-feed roller 28, are each provided with sheet grippers which grip the leading edge of the sheet to pull the sheet around the cylinder in the direction as indicated by the associated arrows. The transfer cylinder 10 in the delivery position T4 is not equipped with grippers, and includes instead a large longitudinal opening A which provides clearance for passage of the delivery gripper bars.

The function and operation of the transfer cylinders and associated grippers of the printing units are believed to be well known to those familiar with multi-color sheet fed presses, and need not be described further except to note that the impression cylinders 26 function to press the sheets against the blanket cylinders 24 which applies ink to the sheets, and the transfer cylinders 10 convey the sheets away from the impression cylinders with the wet printed side of each sheet facing against the support surface of the transfer cylinder 10. Preferably, since each transfer cylinder 10 supports the printed sheet with the wet printed side facing against the transfer cylinder support surface, each transfer cylinder 10 is provided with a protective, ink repellent flexible jacket covering such as that described in DeMoore U.S. Pat. No. 4,402,267 and marketed by Printing Research, Inc. of Dallas, Tex. under the registered trademark "SUPER BLUE", and includes a low coefficient of friction, electrically conductive cylinder base covering as described below.

Figure 2:
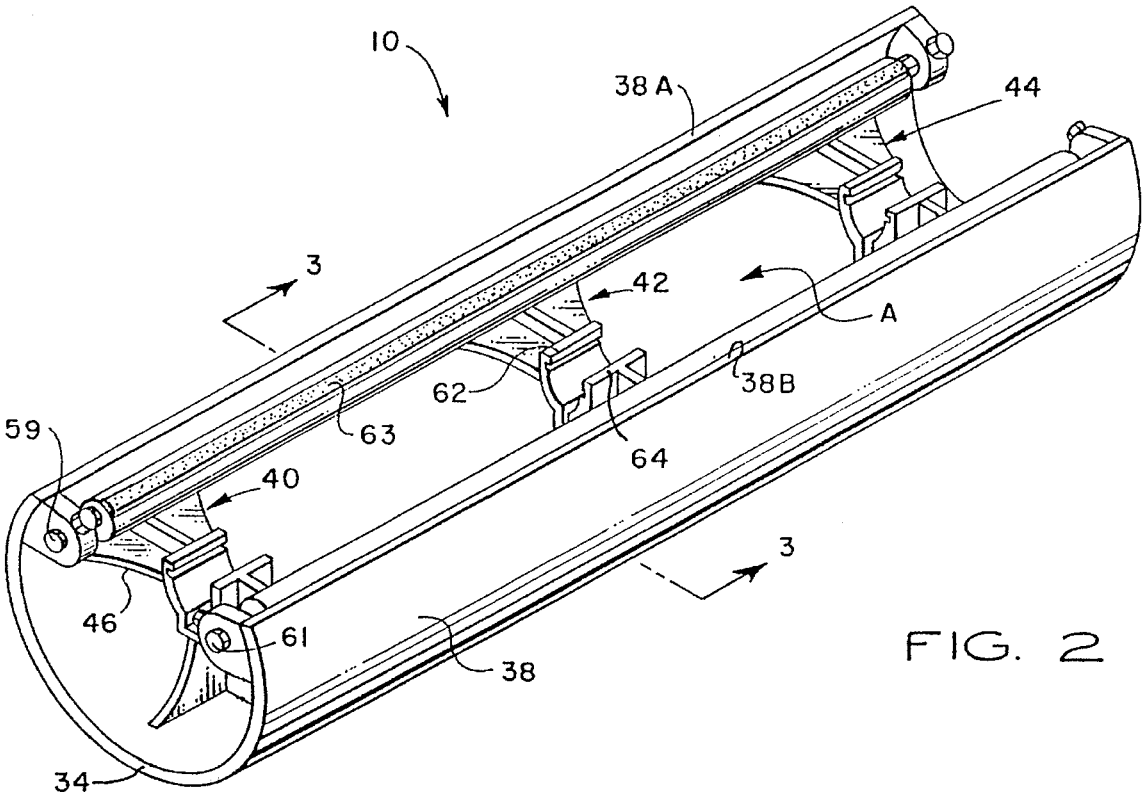
FIG. 2 is a perspective view of a transfer delivery cylinder constructed according to the present invention showing a conductive base covering and a flexible, ink repellent jacket covering installed on the sheet support surface of the transfer delivery cylinder.
Figure 3:
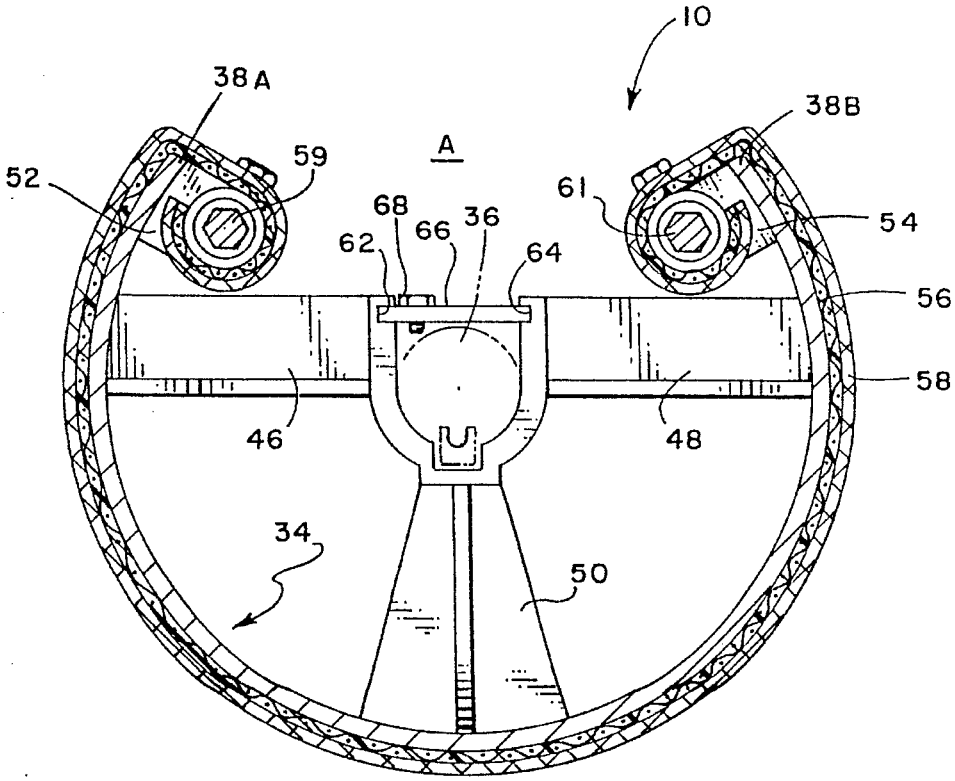
FIG. 3 is a sectional view thereof, taken along the line 3—3 of FIG. 2.

Referring now to FIG. 1, FIG. 2 and FIG. 3, an improved transfer cylinder 10 adapted for use in the delivery position (T4) is characterized by a cylindrical portion 34 which is mountable on the press frame 14 by a shaft 36. When the transfer cylinder is adapted for use in the delivery position (T4), it will be referred to as the "transfer delivery cylinder". The external cylindrical surface 38 of the cylindrical portion 34 has an opening A extending along the longitudinal length of the transfer delivery cylinder between leading and trailing edges 38A, 38B, respectively. The transfer delivery cylinder 10 includes longitudinally spaced hub portions 40, 42, 44 which may be integrally formed with the cylinder 34 to comprise a one-piece construction.

Each hub portion is connected to the cylinder 34 by webs 46, 48 and 50, and support the transfer delivery cylinder 10 for rotation on the shaft 36 on a printing press in a manner similar to the mounting arrangement disclosed in U.S. Pat. No. 3,791,644. As shown in FIG. 2, the transfer delivery cylinder 10 includes opposed elongated integral flange members 52, 54 which extend generally inwardly from the surface of the cylinder 34. The flange portions 52 and 54 include elongated flat surfaces for securing a low coefficient of friction, flexible conductive base covering 56 and a flexible, ink repellent jacket covering 58 as described below.

Referring now to FIG. 2 and FIG. 3 of the drawings, there is illustrated in detail the improved construction of the transfer delivery cylinder 10 of the present invention including the conductive base covering 56 and the flexible, ink repellent jacket covering 58 for providing supporting contact with the printed side of a sheet S while conveying the printed sheet to the next printing unit or to the press delivery stacker. Although the fluoropolymer covered transfer delivery cylinder disclosed in my U.S. Pat. No. 3,791,644 and the ink .repellent flexible jacket covering disclosed in my U.S. Pat. No. 4,402,267 provided improvements in transferring freshly printed sheet material, we have discovered that the provision of an electrically conductive, low friction base covering on the supporting surface 38 of the transfer cylinders further enhances the ability of each transfer cylinder 10 to support and convey successive sheets of printed material with wet ink thereon without transferring the wet ink from a previous sheet to successive sheets and without marking or depressing the surface of the freshly printed sheet.

Figure 4:
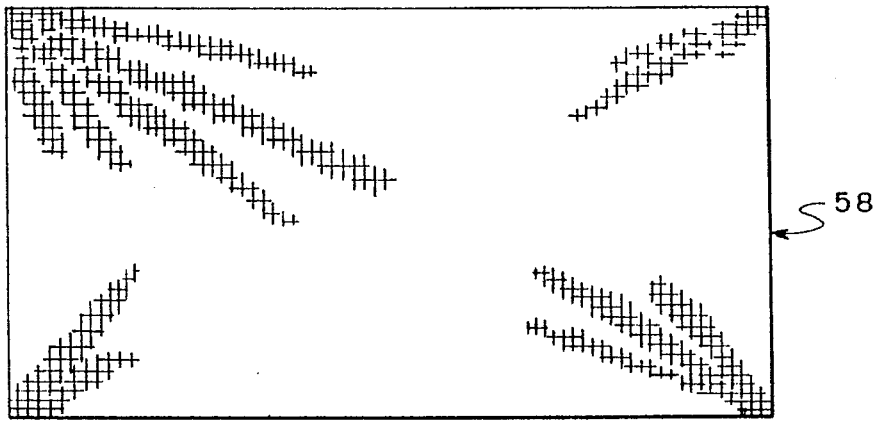
FIG. 4 is a top plan view of a flexible, ink repellent jacket covering.
Figure 5:
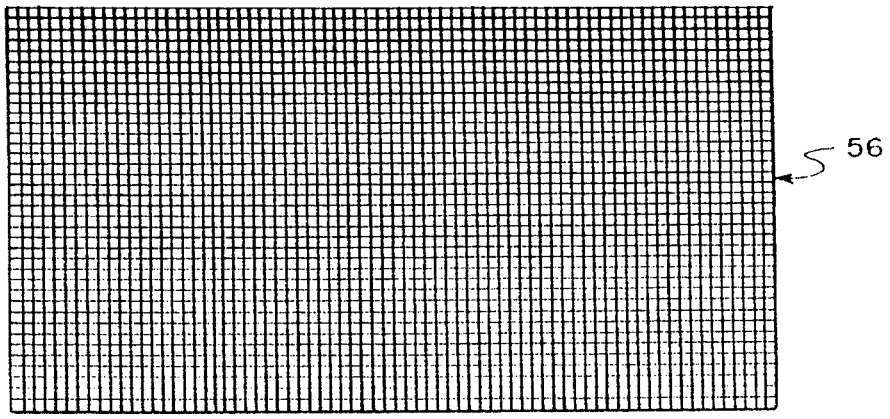
FIG. 5 is a top plan view of a conductive base covering.

In accordance with one aspect of the present invention, it has been determined that a low coefficient of friction resin compound, preferably a dielectric resin containing a conductive agent, has produced a substantial improvement in the transferring of printed sheet material that has wet ink on one surface thereof as it passes over and is supported by the transfer delivery cylinder 10. A suitable conductive base covering 56 in accordance with the present invention and illustrated in the embodiment of FIG. 5 comprises a woven material having warp and weft strands 56A, 56B which are covered with a conductive compound 57. The conductive base covering 56 and flexible, ink repellent jacket covering 58 are attached to the flanges 52 and 54 and are wrapped around the cylinder support surface 38, as shown in FIG. 3. The flexible, ink repellent jacket covering 58 and the conductive base covering 56 are both preferably of rectangular shape as shown in FIG. 4 and FIG. 5, and are dimensioned to completely cover the external cylindrical support surface 38 of the cylinder 34.

Preferably, the conductive compound 57 is polytetrafluoroethylene resin (PTFE), for example as sold under the trademarks TEFLON and XYLAN. The cylinder base covering material 56 comprises warp and weft (fill) strands 56A, 56B of polyamide fiberglass, woven together in a base fiber thickness of approximately 0.007 inch. The woven material is coated with conductive PTFE to a finished thickness in the range of 0.009–0.011 inch, a finished weight in the range of 17–20 ounces per square yard, with a tensile strength of approximately 400×250 warp and weft (fill) (pounds per square inch). In one embodiment, the polyamide fiber comprises woven fiberglass filaments 56A, 56B covered by conductive PTFE according to MIL Standard Mil-W-18746B. The PTFE resin contains electrically conductive carbon black, or some other equivalent conductive agent such as graphite or the like, preferably in an amount sufficient to provide a surface resistivity not exceeding approximately 100,000 ohms/square.

While polyamide fiber covered or coated with polytetrafluoroethylene (PTFE) resin or a fluorinated ethylene propylene (FEP) resin impregnated with carbon black is preferred, other synthetic or natural organic resins including linear polyamides such as that sold under the trade name NYLON, linear polyesters such as polyethylene terephthlate sold under the trade name MYLAR, hydrocarbon or halogenated hydrocarbon resins such as polyethylene, polypropylene or ethylene-propylene copolymers, and acrylonitrile butadinene styrene (ABS) have a low coefficient of friction surface and can also be combined with a conductive agent, such as carbon black, graphite or the like, to render the compound electrically conductive.

In the preferred embodiment, the surface resistivity of the conductive base covering 56 does not exceed approximately 75,000 ohms/square. Other surface resistivity values may be used to good advantage, for example in the surface resistivity range of 50,000 ohms per square to 100,000 ohms per square. The coefficient of friction and conductivity of the base covering material are influenced by the presence of the conductive agent. Consequently, the amount of conductive agent included in the fluoropolymer resin for a given conductivity or surface resistivity will necessarily involve a compromise with the coefficient of friction. Generally, high conductivity (low surface resistivity) and low coefficient of friction are desired. The amount of conductive agent contained in the fluoropolymer resin preferably is selected to provide a surface resistivity not exceeding approximately 75,000 oils/square and a coefficient of friction not exceeding approximately 0.110.

Referring to FIG. 2 and FIG. 3, a suitable method of attaching the conductive base covering 56 and the ink repellent, flexible jacket covering 58 to the transfer cylinders is illustrated. The conductive base covering 56 is held in tension around the cylinder surface 38 by ratchet clamps 59, 61. After the conductive base covering 56 has been secured in place, the flexible, ink repellent jacket covering 58 is loosely disposed about the conductive base covering 56, with its end portions being secured about a VELCRO fastener strip 63.

An important aspect of the present invention concerns reducing the coefficient of friction of the support surface 38 of the cylinder 34. The improved cylinder base support surface has a coefficient of friction less than the frictional coefficient of the cylinder surface 38 such as may be provided by coating the external surface 38 of the cylinder 34 with a fluoropolymer as taught by U.S. Pat. No. 3,791,644, but which has structurally differentiated surface portions which reduce the surface area available for frictional contact by the flexible jacket covering. Although the combination of the fluoropolymer coating described in U.S. Pat. No. 3,791,644, together with the ink repellent flexible jacket covering 58 provides acceptable performance, it has been discovered that the radially projecting surface portions of the embodiments of FIGS. 5, 7, 8, 9 10, 11 and 12 provide improved, low frictional slip surfaces which perform substantially better in reducing accumulation of ink deposits on the surface of the flexible, ink repellent jacket covering 58.

Figure 6:
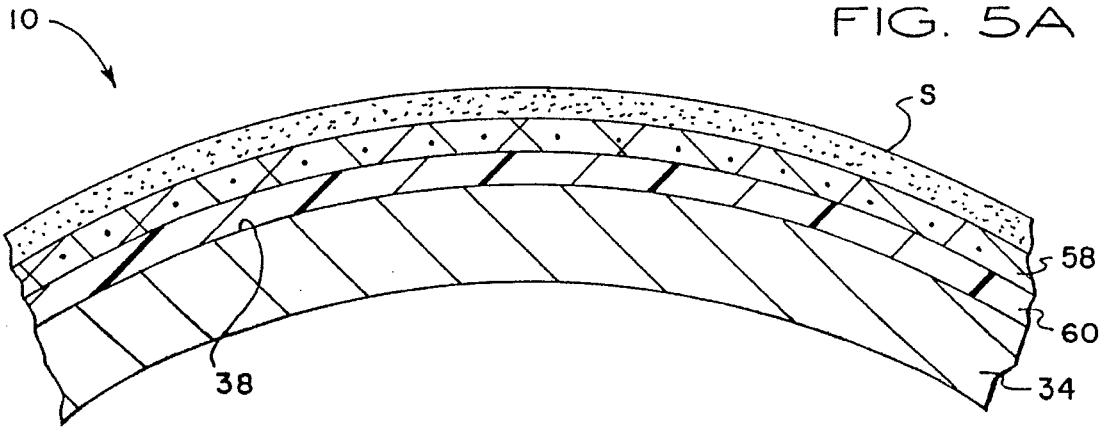
FIG. 6 is an enlarged sectional view, partially broken away, of the transfer delivery cylinder of FIG. 2 having a conductive base covering in the form of a layer of fluorinated polymer resin.

Referring to FIG. 6, a low friction, conductive base support surface is also provided by a conductive coating layer 60 applied directly on the cylinder support surface 38. A fluorocarbon composite coating material containing a conductive agent is applied in a layer to the support surface 38 of the cylinder 34. A preferred conductive composition for providing the coating 60 is a polytetrafluoroethylene (PTFE) resin made under the trademark XYLAN by the Whitford Corporation, Westchester, Pa., impregnated with carbon black. A satisfactory coating type is XYLAN 1010 composite coating material which is curable at low oven temperatures, for example 250° F.

The preparation of the conductive base covering 60 as described provides a substantially glazed surface having a low coefficient of friction of about 0.110, which is conductive (surface resistivity of about 75,000 ohms/square) and also provides for ease of movement of the ink repellent, flexible jacket covering 58 when the same is attached to the transfer delivery cylinder 10. Although the low friction, conductive fluoropolymer coating 60 is particularly advantageous, it is contemplated that other conductive coatings may be applied to the transfer cylinder surface 38 to produce a comparable low friction conductive support surface for the ink repellent, flexible jacket covering 58.

Both the woven conductive base covering 56 (FIG. 3) and the conductive base layer 60 (FIG. 6) have provided the improvement of reducing ink marking in high speed printing equipment and have also, in combination with the ink repellent, flexible jacket covering 58, eliminated depressions and indentations in the paper surface of the sheets. After the conductive base layer 60 has been prepared, the ink repellent, flexible jacket covering 58 is applied to the flanges 52 and 54 by the fastener strips 63 or other suitable fastening means. The flexible jacket covering is secured loosely enough so that with light finger pressure, the ink repellent, flexible jacket covering 58 may be moved easily over the surface of the conductive base covering 60 in all directions by at least one-sixteenth inch to about one inch deflection or more.

Figure 7:
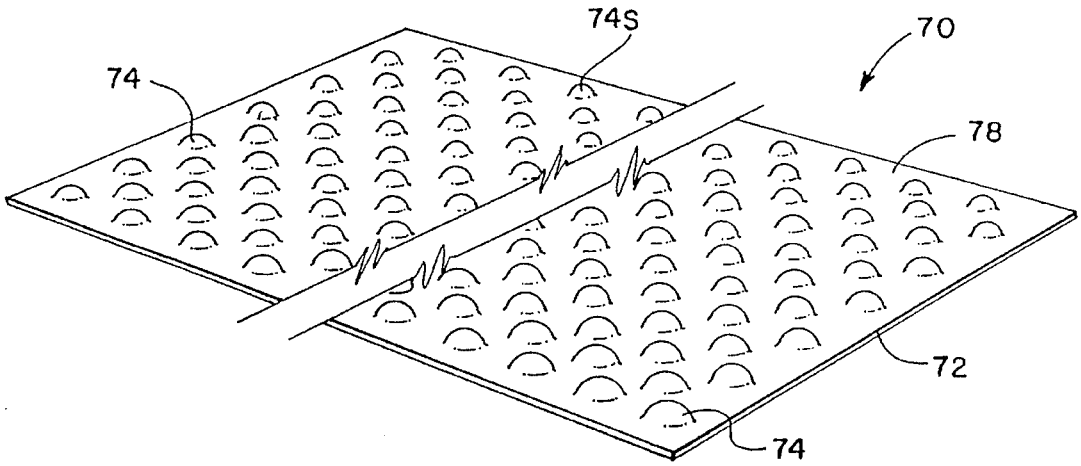
FIG. 7 is a perspective view showing an alternative embodiment of a conductive base covering having node projections.
Figure 8:
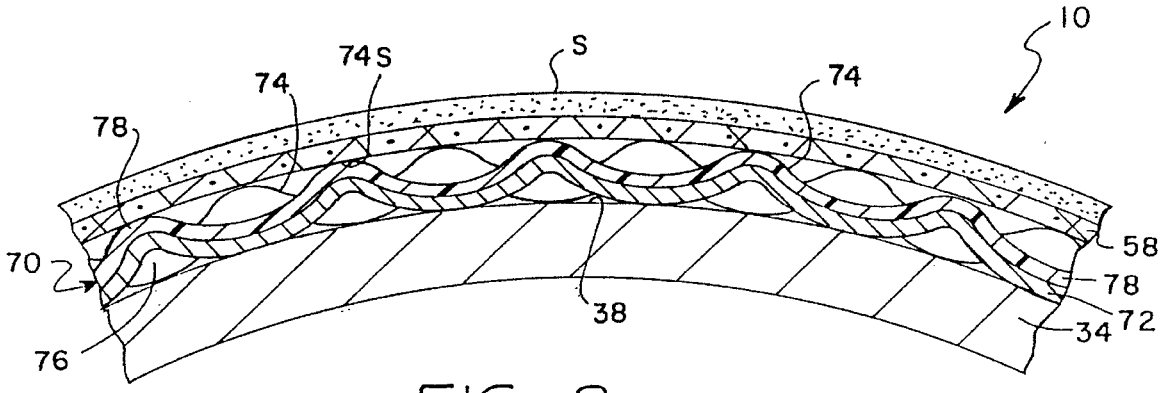
FIG. 8 is a sectional view showing the conductive base covering of FIG. 7 installed on a transfer cylinder.

Referring now to FIG. 7 and FIG. 8, an alternative embodiment of a base covering is illustrated. In that embodiment, a base covering 70 comprises a carrier sheet 72, formed of a moldable material such as plastic or the like. According to an important aspect of this alternative embodiment, the carrier sheet 72 is molded or formed to produce multiple nodes or radial projections 74 on the sheet engaging side of the carrier sheet 72. Each node 74 has a curved, sheet engageable surface 74S which is radially offset with respect to the curved transfer path of the sheet S.

Preferably, the nodes 74 and the surface of the carrier sheet 72 are covered by a layer 78 of a conductive, low friction resin compound, for example, a fluoropolymer impregnated with a conductive agent such as carbon black or graphite. Polytetrafluoroethylene (PTFE) impregnated with carbon black is preferred for this embodiment, and is applied in a layer directly onto the surface of the carrier sheet 72 as previously described. The nodes 74 have a radial projection with respect to the carrier sheet 72 of approximately four mils with a circumferential spacing between each node of approximately two mils. The carrier sheet 72 is pulled tightly under tension about the supporting surface 38 of the cylinder 34 so that good electrical contact is made. The low friction, conductive coating 78 is applied directly to the carrier sheet, whereby electrical charges delivered by the printed sheet S to the flexible jacket covering 58 are directed away from the flexible jacket covering 58 and are conducted through the carrier sheet 72 into the cylinder 34 and into the grounded press frame 14.

The carrier sheet 72 should have a gauge thickness which is sufficient to provide strength and dimensional stability and yet be flexible enough to easily wrap around the transfer cylinder 34. Generally, gauge thicknesses in the range of about 2 mils to about 24 mils, depending on press clearance and press design.

Referring again to FIG. 8, one advantage provided by the node embodiment is reduced surface contact between the flexible, ink repellent jacket covering 58 and the base covering 70. Because of the curved configuration of the nodes 74 and the node spacing, there is less surface area available for contact by the flexible jacket covering 58. Consequently, the force of frictional engagement is substantially reduced, thus permitting free movement of the flexible jacket covering 58 relative to the transfer cylinder base covering. Additionally, the reduced frictional engagement results in a longer service life for the ink repellent, flexible jacket covering 58.

Figure 9:
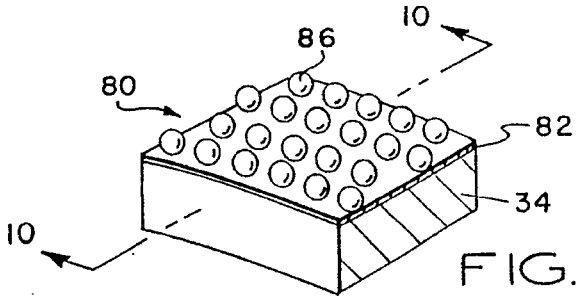
FIG. 9 is a perspective view of a portion of the transfer cylinder of FIG. 2 whose transfer surface is covered by a layer of conductive beads.
Figure 10:
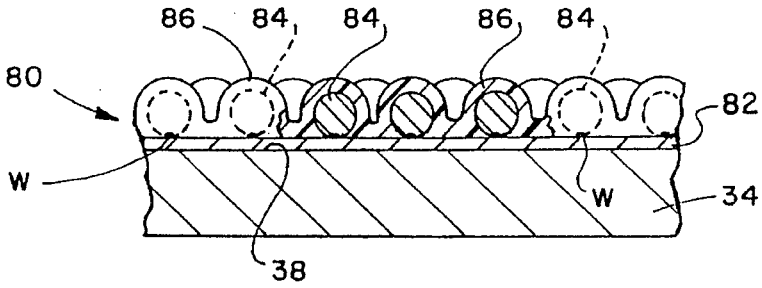
FIG. 10 is a longitudinal sectional view thereof.

Referring now to FIG. 9 and FIG. 10, yet another conductive base covering embodiment is illustrated. In this embodiment, a low friction, conductive base covering 80 comprises a metal foil carrier sheet 82, constructed of a malleable metal such as aluminum, copper or zinc or the like. The conductive carrier sheet 82 has multiple conductive beads 84 secured to its external surface by electrical weld unions W. The surface of the conductive carrier sheet 82 and the conductive beads 84 are covered by a layer 86 of a fluoropolymer resin which contains a conductive agent, for example polytetrafluoroethylene resin (PTFE) containing carbon black, as previously specified.

The conductive beads 84 have a diameter of approximately six mils, and the thickness of the low friction, conductive coating layer 86 is approximately 2 mils. Preferably, the coated beads are arranged in a rectilinear pattern and are circumferentially spaced with respect to each other by approximately 3 mils. The gauge thickness of the conductive carrier sheet 82 is in the range of approximately 2 mils to approximately 24 mils, depending on press clearance and design.

The spacing and curvature of the coated beads reduces the amount of surface available for contact with the flexible jacket covering 58. The low friction surface provided by the PTFE resin layer 86, together with the circumferential spacing, and radially projecting portions of the beads substantially reduce the area of frictional engagement, thus reducing surface contact between the flexible jacket covering 58 and the underlying cylinder base covering 80.

Figure 11:
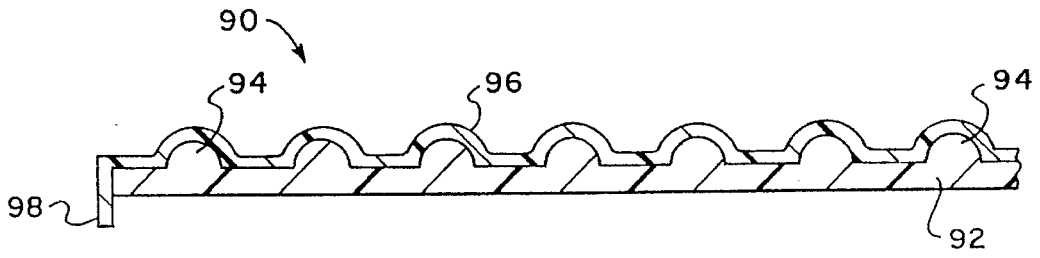
FIG. 11 is a sectional view showing an alternative embodiment of a conductive base covering having node projections.
Figure 12:
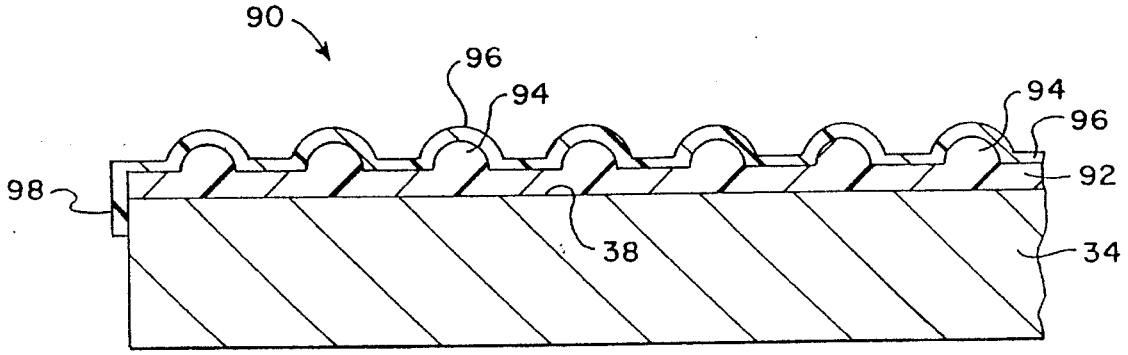
FIG. 12 is a sectional view showing the conductive base covering of FIG. 11 installed on a delivery cylinder.

Yet another embodiment of a low frictional slip, conductive base covering is shown in FIG. 11 and FIG. 12. In this alternative embodiment, a conductive base covering 90 comprises a base carrier sheet 92 of a moldable, plastic material having integrally formed spherical projections 94 arranged in a rectilinear array. The base carrier sheet 92 and the spherical projections 94 are covered by a conductive layer or coating 96 of a fluoropolymer resin which contains a conductive agent, for example polytetrafluoroethylene resin (PTFE) containing carbon black or graphite, as previously specified.

In the molded carrier sheet embodiment shown in FIG. 11 and FIG. 12, the conductive layer or coating 90 is secured in electrical contacting engagement with the cylinder 34 by a linking portion 98. The coated, spherical projections 94 are spaced with respect to each other by approximately 3 mils. The gauge thickness of the base carrier sheet 92 is in the range of approximately 2 mils to as much as 24 mils or more, subject to press clearance. The spherical projections 94 have a radius of approximately 3 mils, and the thickness of the low friction, conductive coating layer 96 is approximately 2 mils. The radially projecting portions 94 substantially reduce the surface area available for contact, thus reducing frictional engagement between the flexible jacket covering 58 and the base covering 90.

Figure 5A:
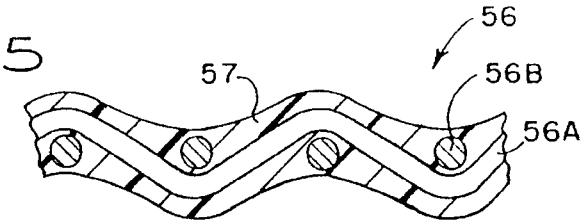
FIG. 5A is a simplified sectional view thereof showing weft and warp strands.

The woven embodiment of FIG. 5, FIG. 5A and the node embodiments of FIG. 7 through FIG. 12 reduce the amount of surface available for contact with the flexible jacket covering 58. For example, the overlapping warp and weft (fill) strands 56A, 56B of the woven embodiment shown in FIG. 5A provide a lattice-like framework of radially projecting portions that reduces the surface area available for frictional engagement by the flexible jacket covering 58. The low frictional coefficient support function is also provided by the radially projecting node embodiments of FIGS. 7–12.

An additional advantage provided by the foregoing embodiments is that the structurally differentiated and radially projecting surface portions provided by the woven material and by the nodes concentrate or focus the area of electrostatic discharge between the flexible, ink repellent jacket covering and the conductive base covering. The raised or projecting surfaces associated with the woven material and the nodes provide reduced area discharge points or electrostatic precipitation points where the electric field intensity is increased, thus enhancing the conduction of the electrostatic charge from the flexible, ink repellent jacket covering through the conductive base covering and into the cylinder 34 and into the grounded press frame 14.

Figure 13:
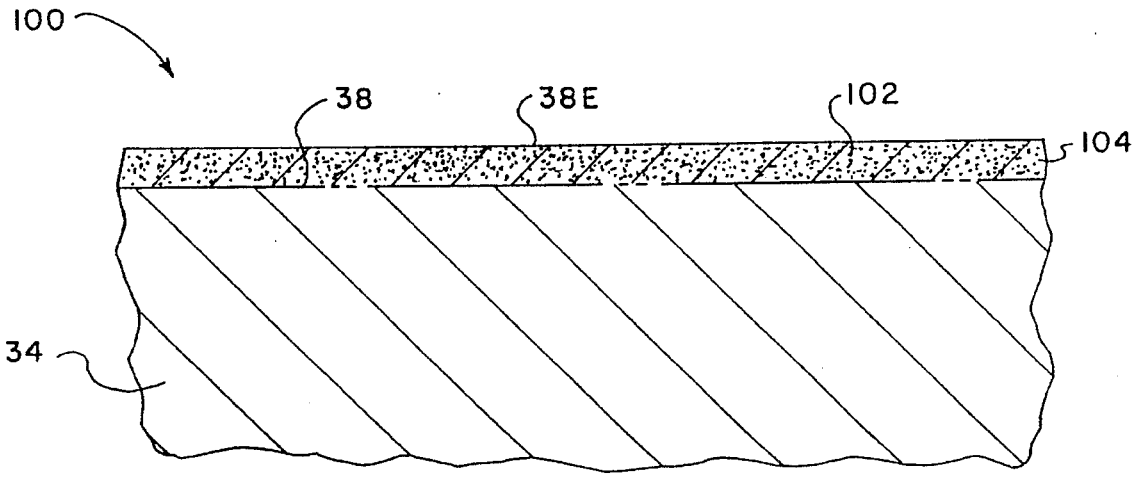
FIG. 13 is an enlarged sectional view, partially broken away, of a transfer cylinder whose transfer surface has been infused with low friction polymeric particles.

Referring now to FIG. 13, yet another conductive base covering embodiment is illustrated. In this embodiment, a low friction, conductive base covering 100 comprises an infusion of organic lubricant particles 102, preferably polytetrafluoroethylene (PTFE) which are infused into the support surface 38 of the cylinder 34. The support surface 38 is covered or plated by a porous, thin metal film 104, with the PTFE particles being infused through the porous layer, and partially into the cylinder 34, thus providing a conductive base support surface 38E which has a low coefficient of friction.

The infusion of a low friction coefficient, organic lubricant material such as PTFE is carried out by providing a thin metal film coating 104 of a porous alloy of nickel or cobalt, or the like, with boron or the like, which is electrochemically deposited on the cylinder surface 38. The cylinder 34 is immersed in a catalytic nucleation plating bath containing a nickel salt and a borohydrite reducing agent, with the plating rate being adjusted to provide a nickel-boron coating layer 104 at a plating deposition rate on the order of approximately 1–2 mils/hour. The plating nucleation is terminated after the coating layer 104 has formed a metallurgical union with the cylinder surface 38, but where the coating layer 104 still retains voids that provide a porosity of the order of about 20%–50%, and having a radial thickness of approximately one mil or less.

After rinsing and drying, the nickel-boron thin film 104 is heat treated to improve metal bond integrity and to increase the hardness of the porous thin film layer 104 from about 58–62 Rockwell "C" to about 70–72 Rockwell "C". The heat treatment is preferably carried out at a temperature of approximately 650° F.

A low friction coefficient organic lubricant material, for example PTFE, is then applied to the porous surface 38E, and is further heat treated to cause the organic lubricant material to flow into the voids of the porous alloy layer 104. Preferably, the organic lubricant material is infused during the heat treatment at higher temperatures above the melting point of the organic lubricant (preferably at a temperature in the range of approximately 580° F. to approximately 600° F. for polytrafluoroethylene) to cause mixing, flow and infusion until the voids of the porous metal film coating 104 are completely filled, thus providing a reservoir of organic lubricant material.

After infusion of the organic lubricant 102, the surface 38E is burnished and polished to remove excess material, exposing the bare metal alloy surface 38E and pores which have been filled with the organic lubricant. The result is a hardened surface 38E which has a coefficient of friction lower than that of the cylinder surface 38 and is electrically conductive.

Figure 14:
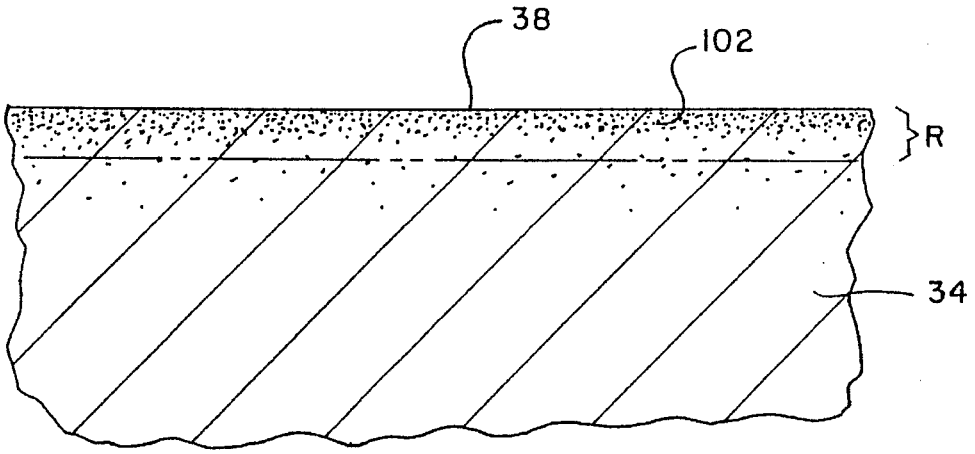
FIG. 14 is an enlarged sectional view, partially broken away, of a transfer cylinder whose transfer surface has been infused with low friction polymeric particles; and, FIG. 15 is a greatly enlarged pictorial representation of a microscopic section taken through an external surface region of the transfer cylinder of FIG. 14.
Figure 15:
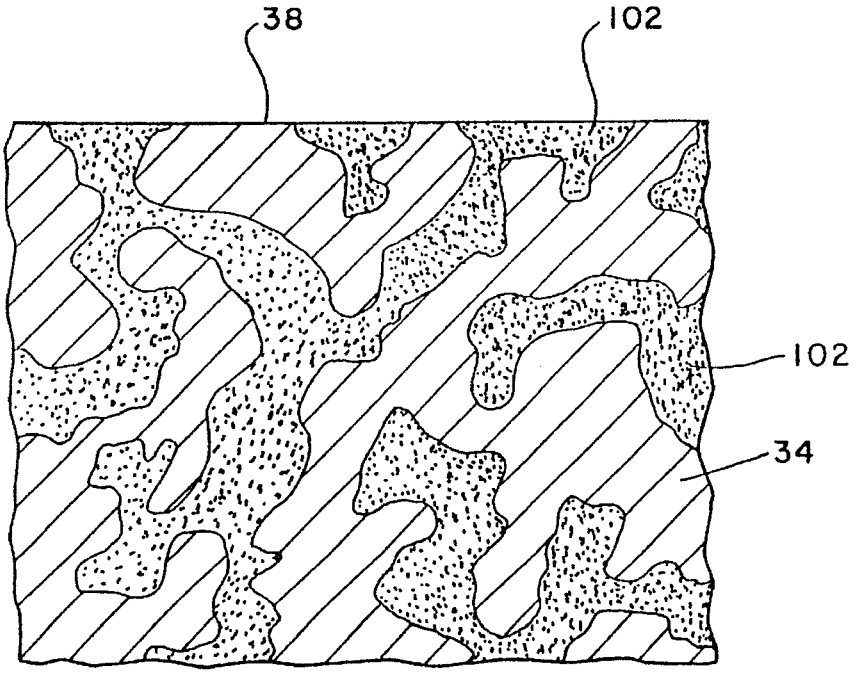

Referring now to FIG. 14 and FIG. 15, an alternative conductive base covering embodiment is illustrated. In this embodiment, the cylinder 34 itself is constructed of a porous metal, for example cast iron. Cast iron is considered to be relatively porous as compared with extruded aluminum, for example. The organic lubricant particles 102 are infused directly into the porous surface region R underlying the support surface 38. The infusion of lubricant 102 is concentrated in the porous surface region R, preferably to a penetration depth of about 0.001 inch. The organic lubricant particles 102 preferably comprise polytetrafluoroethylene (PTFE).

After cleaning, rinsing, and drying the surface 38 of the cylinder 34, the cylinder is heated in an oven at a pre-bake burn-off temperature of about 650° F. to drive off oils and other volatiles from the porous surface region R. The heating step opens and expands the pores in the surface region of the cylinder. While the cylinder 34 is still hot, an organic lubricant, for example PTFE particles suspended in a liquid carrier, are sprayed onto the heated surface 38. After the surface 38 has been thoroughly wetted by the liquid organic lubricant solution, it is placed in an oven and heated at a temperature above the melting point of the organic lubricant (preferably at a temperature on the order of approximately 580° F. to approximately 600° F. for polytetrafluoroethylene) to cause mixing, flow and infusion into the surface pores of the cylinder 34 until the voids in the surface region R are completely filled with the PTFE particles 102. As a result of such heating, the PTFE particles melt and coalesce, while the solvent is boiled and removed by evaporation. After cooling, the surface pores of the cylinder 34 are completely filled with solidified organic lubricant, substantially as shown in FIG. 15.

After infusion and solidification of the organic lubricant 102, the surface 38 is burnished and polished to remove excess material so that the bare metal surface 38 is exposed and the solid lubricant filling in each pore is flush with the bare metal surface 38. That is, any lubricant material 102 or other residue which forms a bridge over the metal surface 38 is removed and the external face of the solidified organic lubricant deposit 102 is leveled with the exposed metal surface 38.

Those skilled in the art will appreciate that various modifications to the method and apparatus of the present invention may be made without departing from the spirit and scope of the present invention as defined by the appended claims.

What is claimed is:

1. A transfer cylinder for supporting a freshly printed sheet as it is transferred from one printing unit to another comprising, in combination:

a rotatable support member having a sheet transfer surface formed by a porous metal surface region;

an infusion of resin material disposed within the porous metal surface region, said resin having a frictional coefficient that is less than the frictional coefficient of the porous metal surface region; and, a flexible jacket covering movably disposed over at least a portion of the resin infused porous metal surface region for engaging one side of a freshly printed sheet during the transfer thereof.

2. The invention as set forth in claim 1, wherein the resin material comprises a fluoropolymer.

3. The invention as set forth in claim 1, wherein the resin material comprises polytetrafluroethylene (PTFE).

4. The invention as set forth in claim 1, wherein the resin material comprises fluorinated ethylene propylene (FEP).

5. The invention as set forth in claim 1, wherein the porous metal surface region comprises cast iron.

6. The invention as set forth in claim 1, wherein the resin material comprises a fluoropolymer resin selected from the group consisting of:

linear polyamides, linear polyesters, including polyethylene terephthalate, hydrocarbon or halogenated hydrocarbon resins including polyethylene, polypropylene and ethylene-propylene copolymers, acrylonitrile butadiene styrene, fluorinated ethylene-propylene polymers and polytetrafluoroethylene.

7. A method for supporting sheet material which has been freshly printed in a printing press, comprising the steps of:

providing a rotatable member having a sheet support surface formed by a porous metal surface region;

infusing a resin material into the porous metal surface region, the resin material having a frictional coefficient that is less than the frictional coefficient of the porous metal surface region;

transferring freshly printed sheet material around the resin-infused porous metal surface region of the rotatable member.

8. A method for supporting sheet material as set forth in claim 7, including the step:

securing a jacket covering of flexible material over at least a portion of the resin-infused porous metal surface region; and engaging the freshly printed sheet material against the jacket covering as the freshly printed sheet material is transferred around the rotatable member.

9. The method as set forth in claim 8, the securing step comprising:

attaching the flexible jacket covering to the rotatable member loosely enough to permit movement of the flexible jacket covering relative to the resin-infused porous metal surface region in response to the normal engaging forces encountered between the freshly printed sheet material and the flexible jacket covering as the freshly printed sheet material is transferred around the rotatable member.

10. In the operation of a printing press having a transfer cylinder for transferring freshly printed sheet material, the improvement comprising the steps of:

infusing a resin material into a porous metal surface region of the transfer cylinder, the resin material having a frictional coefficient that is less than the frictional coefficient of the porous metal surface region; and transferring freshly printed sheet material around the resin-infused porus metal surface region.

* * * * *